United States Patent [19]

Slenker

[11] Patent Number: 5,051,095

[45] Date of Patent: Sep. 24, 1991

[54] MOUNTING BRACKET

[76] Inventor: Stephen Slenker, 26 Cummings Rd., Tyngsboro, Mass. 01879

[21] Appl. No.: 610,824

[22] Filed: Nov. 8, 1990

[51] Int. Cl.[5] ..... H01R 33/00

[52] U.S. Cl. ..... 439/37; 36/2.6; 219/211

[58] Field of Search ..... 439/37; 219/211, 527; 36/2.6

[56] References Cited

U.S. PATENT DOCUMENTS 3,392,264 7/1968 Arron ..... 219/211

3,396,264 8/1968 Murphy et al. ..... 219/527 X 3,663,796 5/1972 Hines et al. ..... 219/527 X

*Primary Examiner*—Eugene F. Desmond

*Attorney, Agent, or Firm*—Wolf, Greenfield & Sacks

[57] ABSTRACT

This invention describes a universal mounting bracket to mount a battery pack for electrical boot warmers. The mounting bracket is secured by a combination strap and clamp in such a way as to prevent the battery pack from being accidentally dislodged by pulling, pushing, lifting, rotating, or from vigorous activity while wearing the boot. Previous devices did not provide a secure mount to a boot and were easily dislodged.

3 Claims, 1 Drawing Sheet

MOUNTING BRACKET

The invention permits a battery pack to be securely mounted to the side of a boot without any modification of the boot. This permits rapid installation and removal of the device and is ideal for temporary mounting such as rental heaters for hunters and skiers. The device provides extremely secure mounting of the battery pack so that it can not be dislodged by pulling, pushing, lifting, rotating or any combination of these motions. Previous devices used a simple clamp or a strap on the leg for mounting batteries. A simple clamp on the top of the boot is easily dislodged when it is employed in a vigorous activity such as skiing. When a battery pack is strapped to a leg, it is generally uncomfortable and is even dangerous in the sport of skiing where frequent falls occur. By strapping the battery pack to the boot and securing it to the top of the boot with a clamp, an extremely safe, stable and secure mounting is obtained which is virtually rigid in position during the most vigorous activity. More features of the invention will become apparant by reviewing the detailed description which follows.

BRIEF DESCRIPTION OF THE DRAWINGS

In FIG. 1., a typical mounting of the device on a boot is shown. The strap 1, is typically wrapped around the upper part of the boot and is typically secured by use of a quick acting snap buckle which is not shown. This buckle is the type normally used on hikers' back packs. A clamp 3, is designed to hook over the top edge of the boot and fit snugly to it. An alternative type strap is an elastic web which requires the user to slip his foot through the loop of the strap in order to be positioned on the boot. The clamp 3 prevents the bracket from sliding down the boot to a lower position and additionally prevents rotation of the bracket if the battery pack should be rotated. The battery pack is typically attached to the battery mount by either a screw or a bayonet action which is not shown. The electrical contacts are made by female spade connectors 6 and 7 to male connectors at the end of the heating element leads 8 and 9.

FIG. 2 shows the rear view of the mounting bracket and mounting strap. The electrical contacts of the device are typically made through female spade connectors 6 and 7 which connect to electrical contacts on the device through screws 10 and 11. There are slits 13, 14, and 15 which permit the straps to be attached. The slits 13 and 14 permit rapid and secure adjustment of the length of the strap. A snap buckle, not shown, permits rapid attachment of the strap around the boot. The strap is typically made of heavy coarse nylon webbing and is extremely strong. The webbing 17 is typically looped at one side of the bracket and sewn to itself at 35. The clamp 13 is designed to fit very tightly around the top of the boot which is typically padded at the top edge. The strap generally fits just below the top padded edge of the boot and is additionally secured and positioned by said pad. By having the clamp at the top of the bracket and the strap at the bottom of the bracket, the bracket is virtually immovable in its position related to the boot.

FIG. 3. shows the front view of the mounting bracket with the battery pack detached. Flat head screws 10 and 11 are inserted into the bracket 30 where special shoulder nuts 31 and 32 are applied from the opposite side. A female spade connector 6 is placed over the screw and the battery pack mount is secured by the screws. The screws provide contact to the spade connectors 6 and 7 and to the shoulder nuts 31 and 32 which make contact to the battery pack. The battery pack is secured by releasable attachment means which is of either the screw or bayonet type and is typically connected to a threaded or bayonet insert 34.

Figure 1:
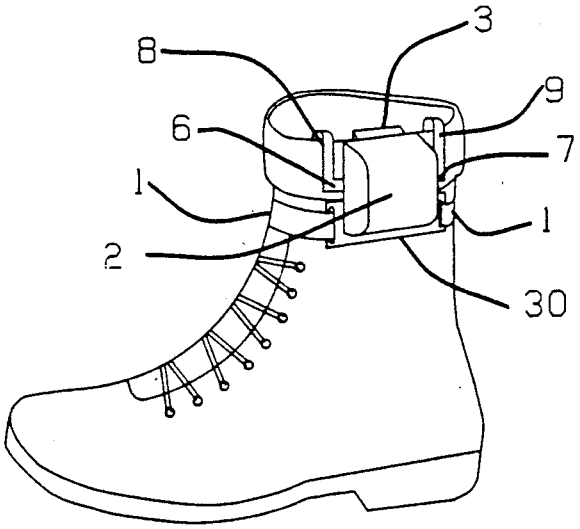
FIG. 1 shows the inventive device secured to a boot.
Figure 2:
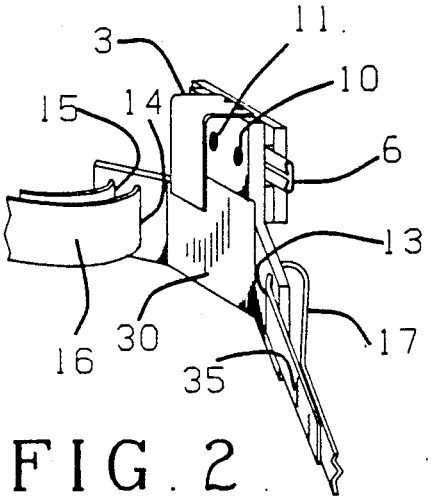
FIG. 2 is a rear or inside view of the mounting bracket and its attachments.
Figure 3:
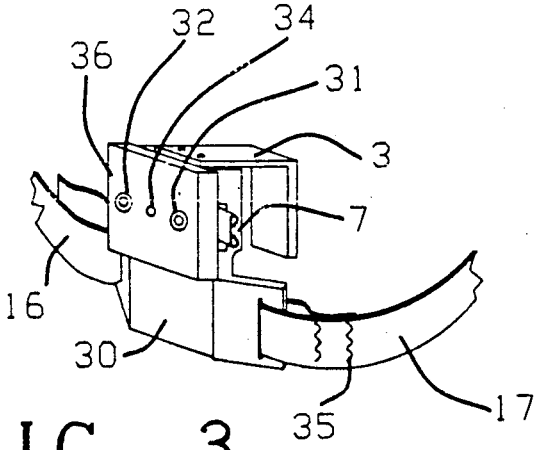
FIG. 3 is a front or outside view of the device shown in FIG. 2.

What I claim is:

1. Means for securing a battery pack to a boot, comprising a bracket shaped to receive and removeably secure a battery pack, a clamp secured to said bracket, said clamp adapted to attach to the top of said boot and secured said bracket, a strap engaging said bracket, said strap adapted to encircle said boot to secure said bracket to the boot and restrict motion of the mounting bracket in relationship to the boot.

2. A means as set forth in claim 1, having electrical contacts secured to said bracket, said contacts adapted to be electrically connected to the battery pack for interconnecting the battery pack with a heatup element.

3. A mounting bracket of claim 1, where said battery pack is removeable, said battery pack being secured to said mounting bracket by releasable attachment means.

* * * * *